United States Patent [19]

Caveney et al.

[11] Patent Number: 4,519,129

[45] Date of Patent: May 28, 1985

[54] MASS TERMINATION CONNECTOR TOOL ASSEMBLY

[75] Inventors: Jack E. Caveney, Hinsdale; Roy A. Moody, Flossmoor; John J. Bulanda, New Lenox; Russell E. Wende, Hometown, all of Ill.

[73] Assignee: Panduit Corp., Tinley Park, Ill.

[21] Appl. No.: 416,530

[22] Filed: Sep. 9, 1982

[51] Int. Cl.[3] ..... H01R 43/04

[52] U.S. Cl. ..... 29/749; 29/753; 29/759; 269/93; 269/239; 269/254 CS; 269/270

[58] Field of Search ..... 29/749, 759, 753, 751; 269/239, 254 CS, 93, 270

[56] References Cited

U.S. PATENT DOCUMENTS

| | | | |
|---|---|---|---|
| 3,845,535 | 11/1974 | Over | 29/203 |
| 3,864,802 | 2/1975 | Tucci | 29/203 |
| 3,885,287 | 5/1975 | Long et al. | 29/203 |
| 4,035,897 | 7/1977 | Over et al. | 29/56.6 |
| 4,160,317 | 7/1979 | Sergeant | 29/749 |
| 4,180,904 | 1/1980 | Nijman | 29/749 |

*Primary Examiner*—Carl E. Hall

*Attorney, Agent, or Firm*—Charles R. Wentzel; Mark D. Hilliard

[57] ABSTRACT

A tool assembly for use with a prime mover, such as a bench press, for terminating a plurality of insulated conductors in a mass terminator connector. The tool assembly includes a pair of supports, at least one of which is adapted for attachment to the prime mover, for reciprocal movement relative to one another. The assembly also includes a conductor insertion die set carried by one of the supports for inserting the conductors into the connector. This die set includes an insertion die corresponding to each terminal element of the connector. Finally, the assembly includes connector holding means carried by the other support for holding the connector in alignment with the die set. The holding means has connector release means for retaining the connector in the holding means and is engageable by the connector and movable by the connector from a retention position to a release position and biased to the retention position. Thus, by pulling the terminated conductors sufficiently to overcome the bias, the connector is released from the holding means.

16 Claims, 20 Drawing Figures

MASS TERMINATION CONNECTOR TOOL ASSEMBLY

BACKGROUND OF THE INVENTION

The present invention relates to tooling for holding articles and, more particularly, to a tooling assembly for holding a mass termination connector during termination of conductors therein.

Insulation displacement mass termination connectors, which function to electrically terminate a plurality of conductors in response to a single stroke of an insertion tool, are coming into increasing commercial prominence because of their tremendous reduction in tedious iterative manual operations in comparison with the previous wiring method of stripping the insulation from each individual conductor, placing a terminal on each stripped end and crimping the respective terminals on the respective conductors. One such mass termination connector, which is fully disclosed in commonly assigned U.S. Pat. No. 4,191,442, includes a housing having front and back walls joined by a plurality of spaced barrier walls defining an array of cavities for holding a plurality of individual metallic terminal elements. Aligned openings in the front and back walls extend from the wire receiving face of the housing to provide entrances to the various cavities so that conductors positioned over the various cavities can be moved laterally of their axes to terminate them in the terminal elements.

A common method of terminating the conductors, which are often in the form of a flat cable, in the connector is by using a tooling assembly mounted in a bench press. Such a tooling assembly includes an insertion finger die set attached to the press ram, and a connector holder affixed to the press bed. These prior tooling assemblies often require operator manipulation of the holder during loading and release of the connector. This can be time consuming and can be dangerous in the event of inadvertent operation of the press. Other prior art tooling assemblies require complexities such as pneumatically operated latch mechanisms, and attendant control circuitry, to effect release of a terminated connector.

SUMMARY OF THE INVENTION

Among the several objects of the present invention may be noted the provision of an improved mass termination connector tool assembly; the provision of such an assembly which permits fast and convenient termination of a flat cable without the operator being required to touch either the connector or the tooling assembly; the provision of such an assembly which reduces the spacing between the insertion die set and the connector to preclude operator injury; the provision of such an assembly which moves the connector into precise alignment with the die set; the provision of such assembly which releases a completed termination in response to the operator exerting a pull on the flat cable in a direction generally opposite to the direction of cable insertion; the provision of such assembly which provides a series of connectors to the termination station in the assembly; and the provision of such assembly which is reliable in use, has long service life and is simple and economical to manufacture. Other objects and features of the present invention will be in part apparent and in part pointed out hereinafter in the specification and in the claims.

Briefly, the tool assembly of the present invention includes a pair of supports for reciprocal movement relative to one another and a conductor insertion die set carried by one of the supports for inserting the conductors into corresponding terminal elements of the connector. The tool assembly also has connector holding means carried by the other support for holding the connector in alignment with the die set. The holding means has connector release means for retaining the connector in the holding means and is engageable by the connector and movable from a connector retention position to a connector release position and biased to the retention position. Pulling of the terminated conductors sufficiently to overcome the bias results in release of the connector from the holding means.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
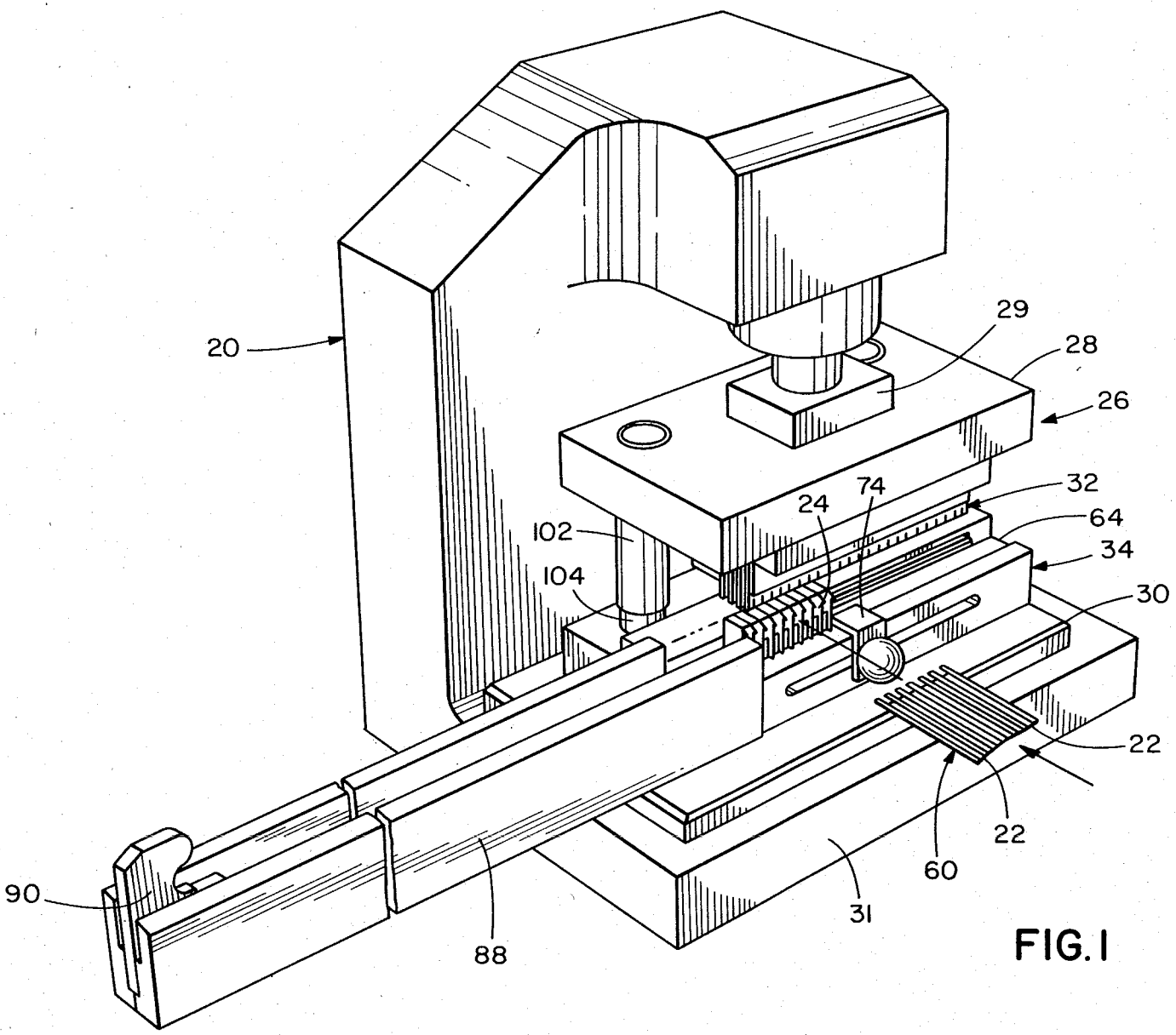
FIG. 1 is a perspective view of a mass termination tool of the present invention mounted in a bench press.
Figure 2:
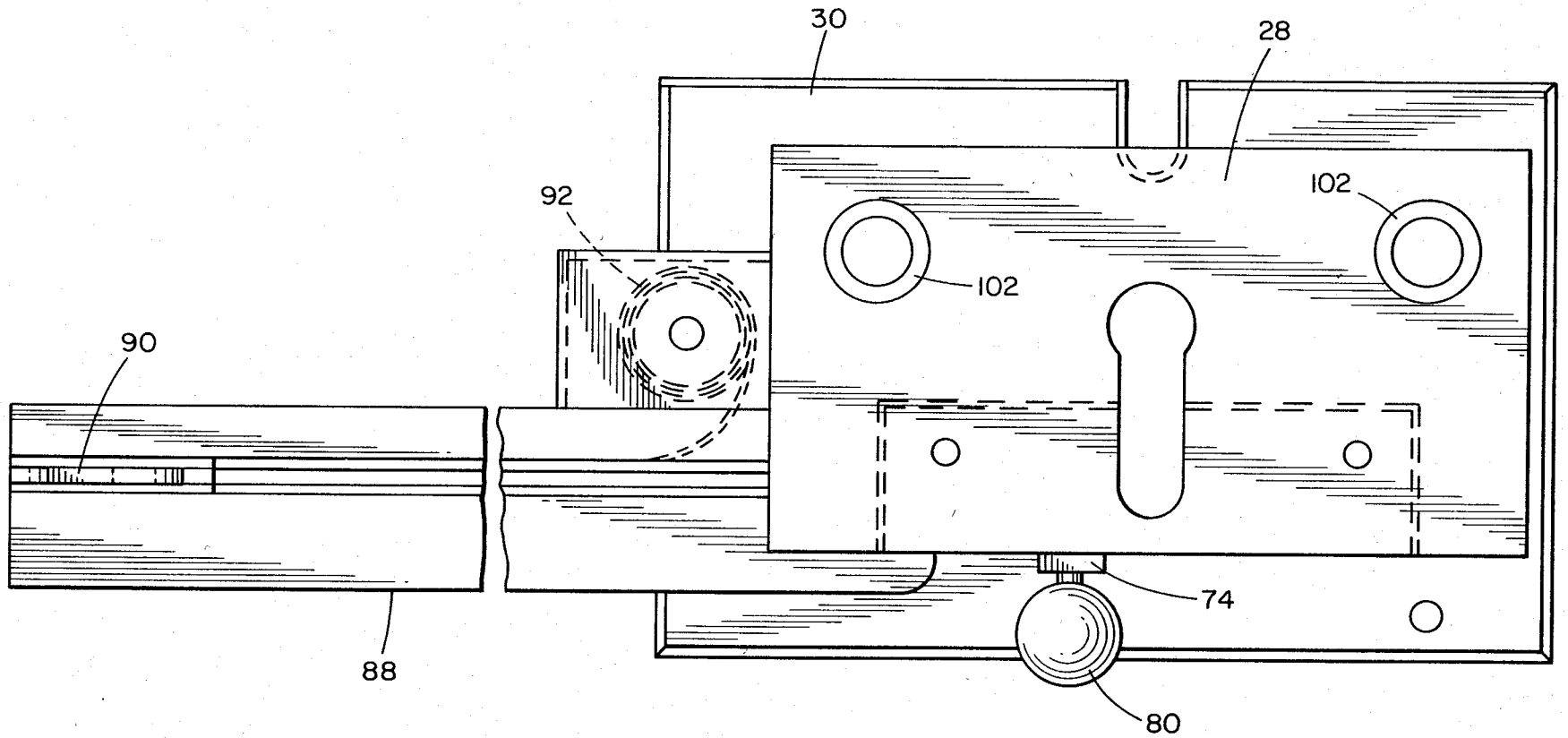
FIGS. 2, 3 and 4 are, respectively, plan, front and side elevational views of the termination tool of FIG. 1.

Referring now to the drawings, a tool assembly for use with a prime mover, such as a bench press 20, to terminate insulated conductors 22 in a mass termination connector 24 is generally indicated in FIG. 1 by reference character 26. The tool assembly includes an upper support 28 adapted for connection to the press ram 29 and a lower support 30 adapted for mounting on the press bed 31. The supports undergo reciprocal movement with respect to one another during operation of the press. The upper support carries a conductor insertion die set 32 while the lower support carries a connector holding means 34 for holding connector 24 in alignment with the die set.

Figure 5:
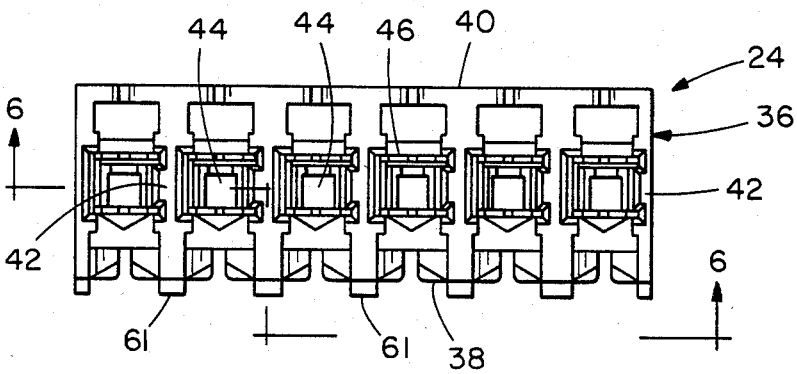
FIG. 5 is a plan of a mass termination connector for use with the termination tool.
Figure 6:
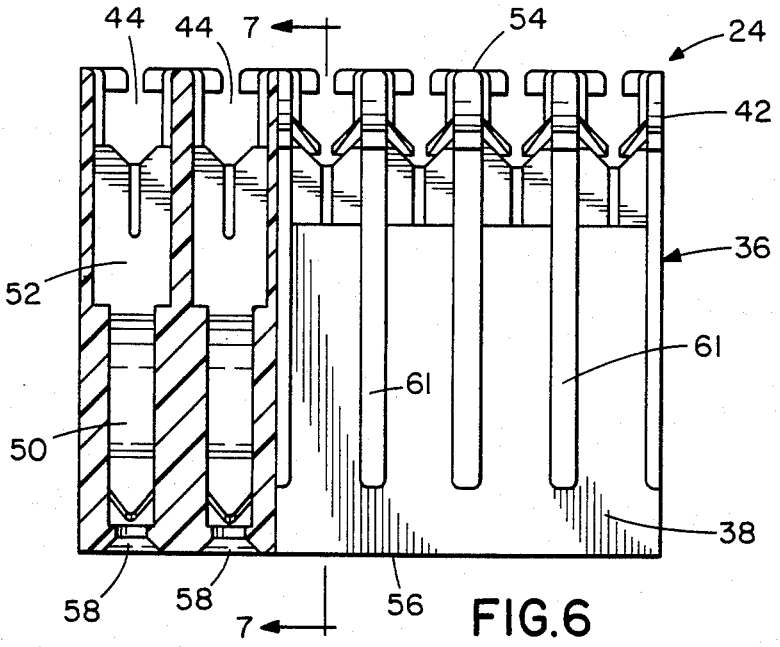
FIG. 6 is a partial sectional view of the connector taken generally along line 6—6 of FIG. 5.
Figure 7:
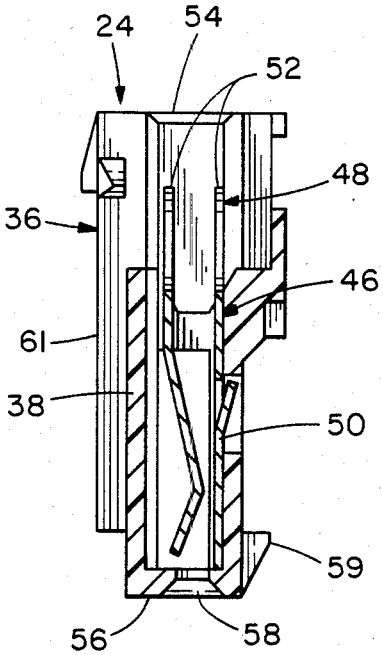
FIG. 7 is a sectional view of the connector taken generally along line 7—7 of FIG. 6.

Connector 24 is best shown in FIGS. 5–7 and comprises an insulative housing made of plastic 36 having a front wall 38, a back wall 40, and a plurality of regularly spaced barrier walls 42 which together define an array of cavities 44. Note that the barrier walls at the ends of the connector have a width which is exactly half that of the intermediate barrier walls. Thus termination tooling will accept a number of shorter connectors placed in series as well as a longer single connector because both have the same parameters. Positioned in each cavity is a metallic terminal element 46 including an insulation displacement conductor receiving portion 48 and a pin receiving portion 50. Conductor receiving portion 48 includes a pair of slotted plates 52 which function to displace the insulation from the conductor upon the die set forcing the conductor laterally of its axial direction into the slots. For this purpose die set 32 includes a die 33 corresponding to each terminal element. Each die includes four aligned fingers 35 for engaging the conductor between plates 52, on either side of the plates, and on the outside of connector front wall 38. Housing 36 further has a top or conductor receiving face 54 and a second or pin receiving face 56 having an aperture 58 adjoining each cavity 44. Front wall 38 carries a plurality of regularly spaced vertical ribs 61. As will be described more fully hereinafter, apertures 58 and ribs 61 are used in junction with precision alignment means. Back wall 40 has a series of feet 59 extending outwardly adjacent pin receiving face 56. A mass termination connector similar to connector 24 is fully illustrated and described in commonly-assigned U.S. Pat. No. 4,191,442.

Figure 8:
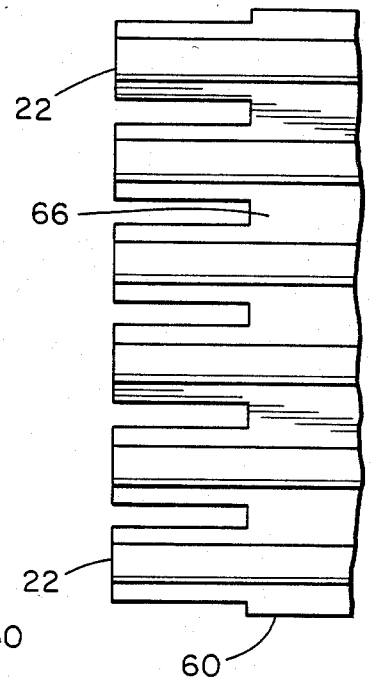
FIG. 8 is a plan of a pre-notched end of a flat cable to be terminated using the tool of the present invention.

Mass termination connectors are well sited for use with a flat cable 60 in which conductors 22 are disposed parallel to one another at regular intervals in a sheet of insulative material. To enable entrance of the end of the flat cable into connector 24 it is common practice to pre-notch the cable. That is, as shown in FIG. 8, the web portion 62 between adjacent conductors is removed so that the flat cable can enter the connector without interference from barrier walls 42. A flat cable preparation tool assembly useful for pre-notching the flat cable end is the subject of commonly-assigned U.S. Pat. No. 4,228,709.

Figure 3:
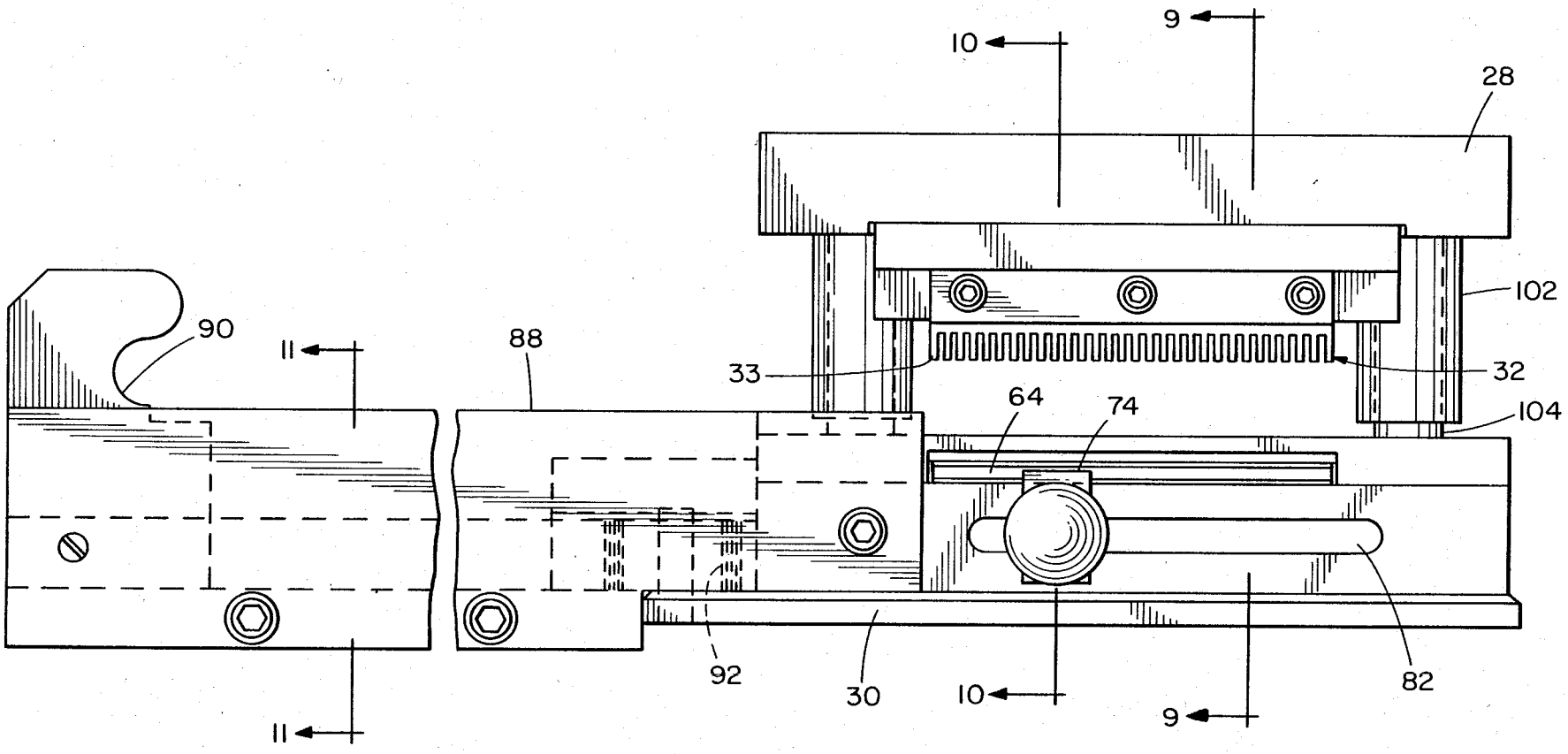
Figure 4:
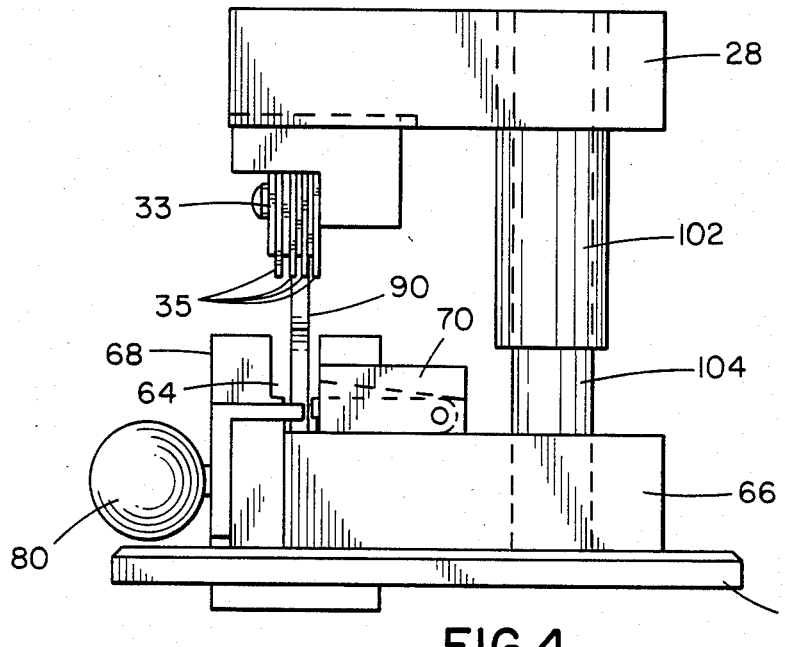
Figure 10:
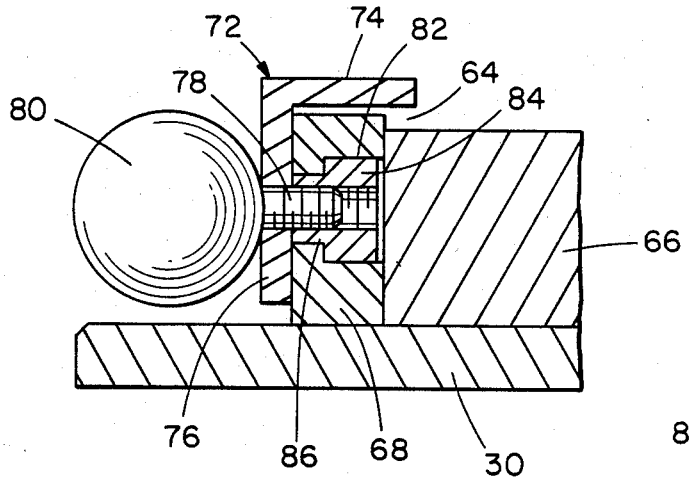
FIG. 10 is a sectional view taken generally along line 10—10 of FIG. 3 with certain components removed illustrating adjustable stop means for engaging a connector positioned in the channel.
Figure 11:
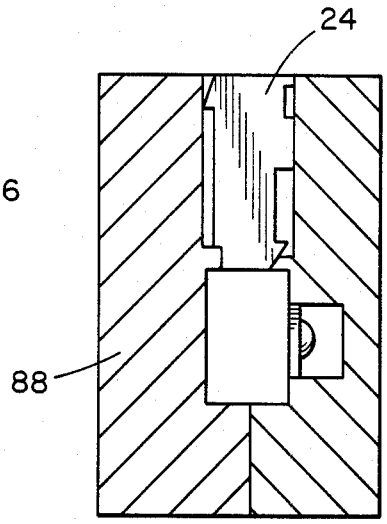
FIG. 11 is a sectional view taken generally along line 11—11 of FIG. 3 showing a feed means for conveying connectors, in seriatum, to the channel.
Figure 9:
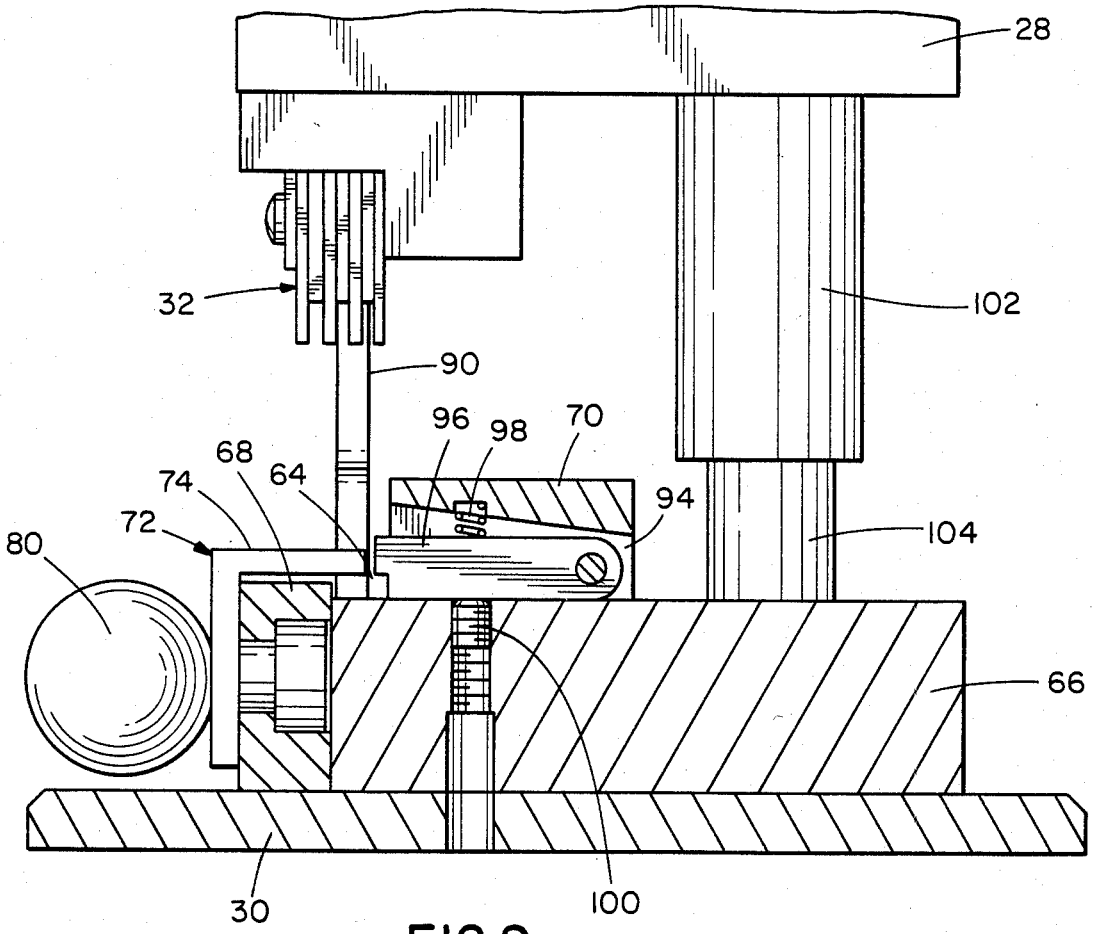
FIG. 9 is a sectional view taken generally along line 9—9 of FIG. 3 depicting a channel in the tool for holding a connector in position for termination.

As best shown in FIGS. 3, 4 and 9, the connector holding means comprises a channel 64 for seating the connector for termination. Channel 64 is defined by a floor 66, attached to lower support 30, a front wall 68 and a rear wall 70 joined by the floor. The tool assembly also includes adjustable stop means, best shown in FIG. 10, for limiting the extent of insertion of a connector in the channel so that the tool assembly can accommodate connectors having different numbers of terminal elements. The stop means include a right angle member 72 the upper horizontal leg or stop 74 of which rides on the top surface of front wall 68 and extends into channel 64 to engage the connector so it is aligned with the die set. The right angle member also has a vertical leg 76 having a hole through which extends the threaded rod 78 of a tightening knob 80. Front wall 68 has an elongate horizontal aperture 82 which, as shown in FIG. 10, is stepped or has a counterbore. Rod 78 extends into aperture 82 and is received by a threaded bore of a slide button 84 seated in the enlarged portion of aperture 82 and having a nose portion 86 having a non-circular periphery extending into the narrowed portion of the aperture to prevent rotation of the button. Referring to FIGS. 3 and 11, lower support 30 also carries a feed track 88 positioned to feed connectors 24 in series into channel 64 toward stop 74. The track has a pusher 90 connected to a negator spring 92 to apply constant force to the connector series. As will be appreciated by those skilled in the art, the feed track is provided with a detent to maintain the pusher fully retracted to permit convenient loading of connectors.

Figure 12:
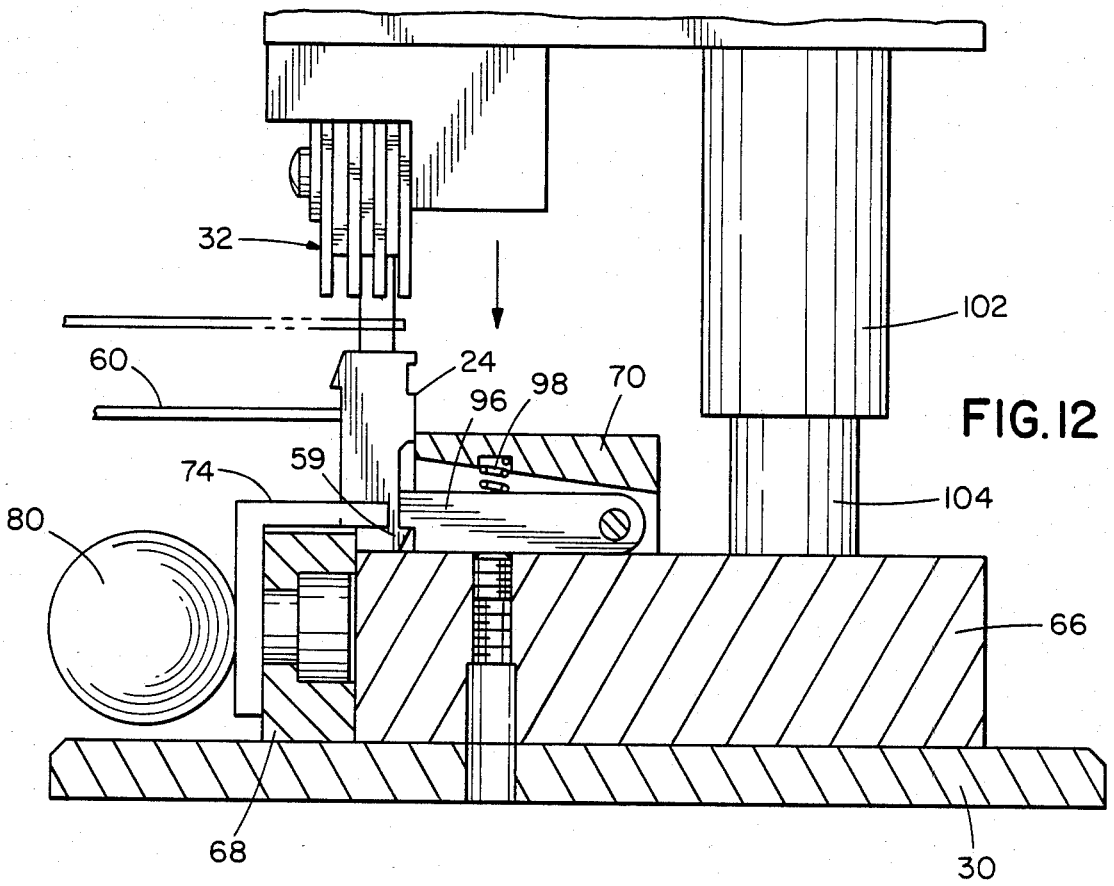
FIG. 12, similar to FIG. 9, shows a connector held in the channel in position for termination.
Figure 13:
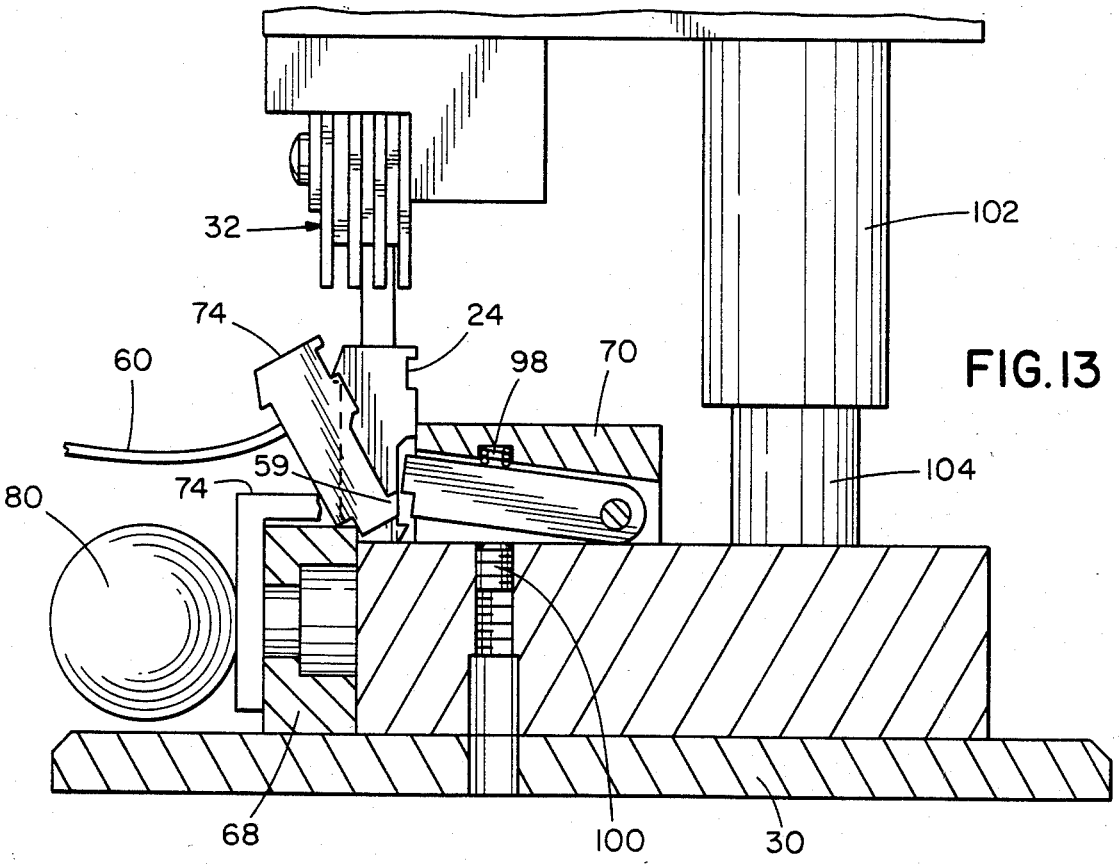
FIG. 13, also similar to FIG. 9, illustrates a terminated connector being released by the tool.

The connector holding means also comprises connector release means for retaining a connector in channel 64 until termination has been completed, and thereafter releasing the connector in response to merely pulling on the terminated conductors. More specifically, rear wall 70 includes a tapered window 94 in which is pivotally mounted a release arm 96, the distal end of which extends into channel 64. Arm 96 is movable between a connector retention position, shown in FIG. 12, in which the arm closely overlies the feet 59 of the connector housing, and a connector release position, FIG. 13, wherein the arm has been deflected sufficiently by feet 59 to permit the connector to escape channel 64. The extension of front wall 68 above the level of floor 66 is quite low in comparison with the height of the connector housing. Upon exerting a pull on the terminated conductors, the connector rotates using the front wall as a fulcrum until the release arm is moved to its release position permitting escape of the terminated connector.

In prior art tool assemblies, the front wall of the connector - receiving channel was relatively high and the terminated connector was removed by lifting it above the level of the channel. This required the ram to have a relatively long stroke to provide adequate clearance for connector removal. The operator using such prior art tool assembly had to exercise great care because there was sufficient space between the insertion assembly of the connector to receive his or her fingers. In the present invention, the low front wall and connector release by its rotation over the front wall permits the use of an extremely short ram stroke to preclude operator injury.

With the terminated connector removed from the channel, the spring biased feed track loads the next upstream connector in position for termination. The rear wall carries a spring 98 engaging the release arm for biasing it to its retention position. Furthermore, the rear wall has an adjustment screw 100 underlying arm 96 for adjusting the retention position of arm 96 to accommodate for any slight variance in connector parameter and to place the arm so that it closely overlies the housing feet 59 but does not interfere with loading of the connectors by the feed track.

To insure alignment between the die set and the connector holder, upper support 28 is provided with a pair of sleeves 102 receiving a pair of cylindrical standards 104, extending from floor 66, in close fitting telescopic relationship.

Operation of tool assembly 26 of the present invention is as follows: Release of pusher 90 from its retracted position after filling feed track 88 with connectors 24 oriented with feet 59 extending rearwardly results in the leading connector being loaded into channel 64 engaging stop 74. Flat cable 60 is positioned with the conductors at its pre-notched end overlying corresponding terminal elements 46 in the connector. Actuation of bench press 20 effects termination of the cable 60 and by merely pulling the termiated cable in the direction opposite to the direction of insertion, release arm 96 is deflected and the connector is removed from the channel 64. The feed track 88 is responsive to removal of the terminated connector to load the next connector. Thus the application speed of tool assembly 26 is limited only by the rate at which the operator can insert and withdraw cables and actuate the press, and the capacity of the feed track.

It is noted that in sharp contrast to prior art tool assemblies, the operator is not required to touch either the tool assembly or, after loading the feed track, the connector. In addition, the short stroke of the ram prevents the operator from inserting a finger between the insertion assembly and the connector. While the tool assembly is ideally suited for use with flat cable, it can also be used with discrete conductors especially if the connectors have relatively few circuits (terminal elements).

Figure 14:
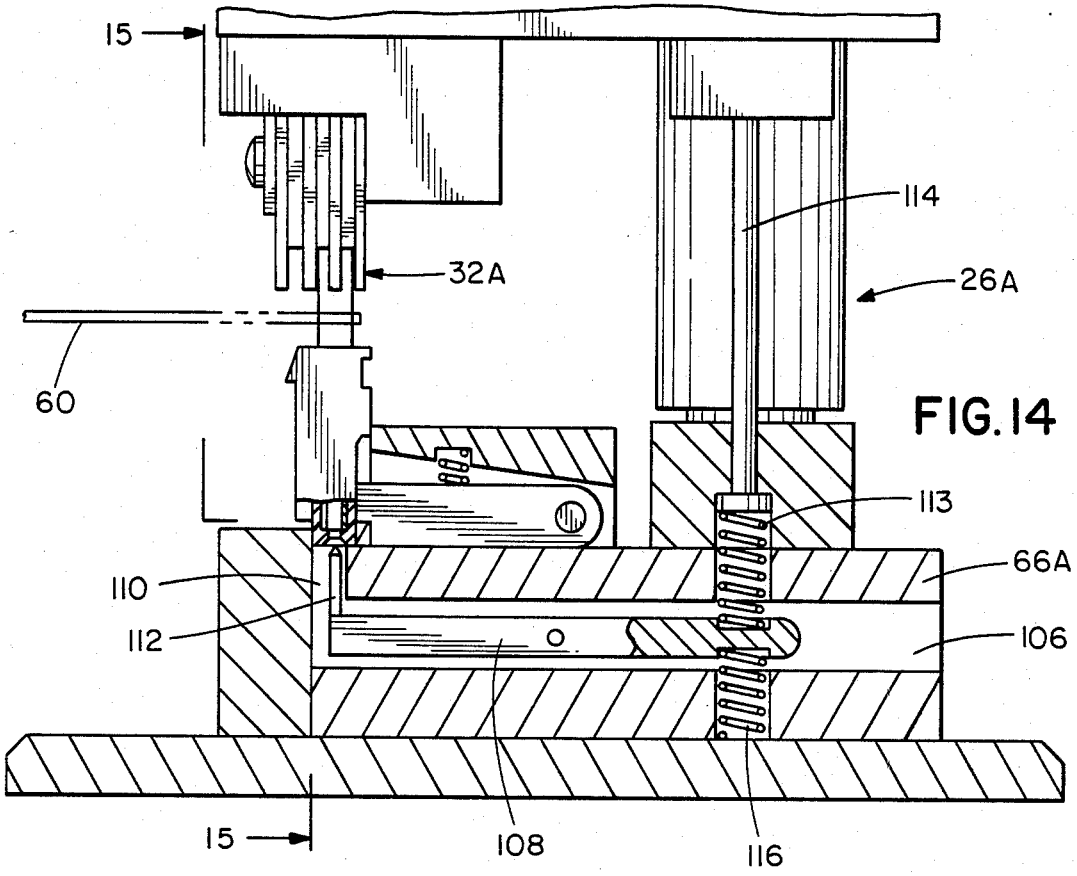
FIG. 14 is a sectional view of a modified tool having alignment means for precisely aligning the connector with an insertion die.
Figure 15:
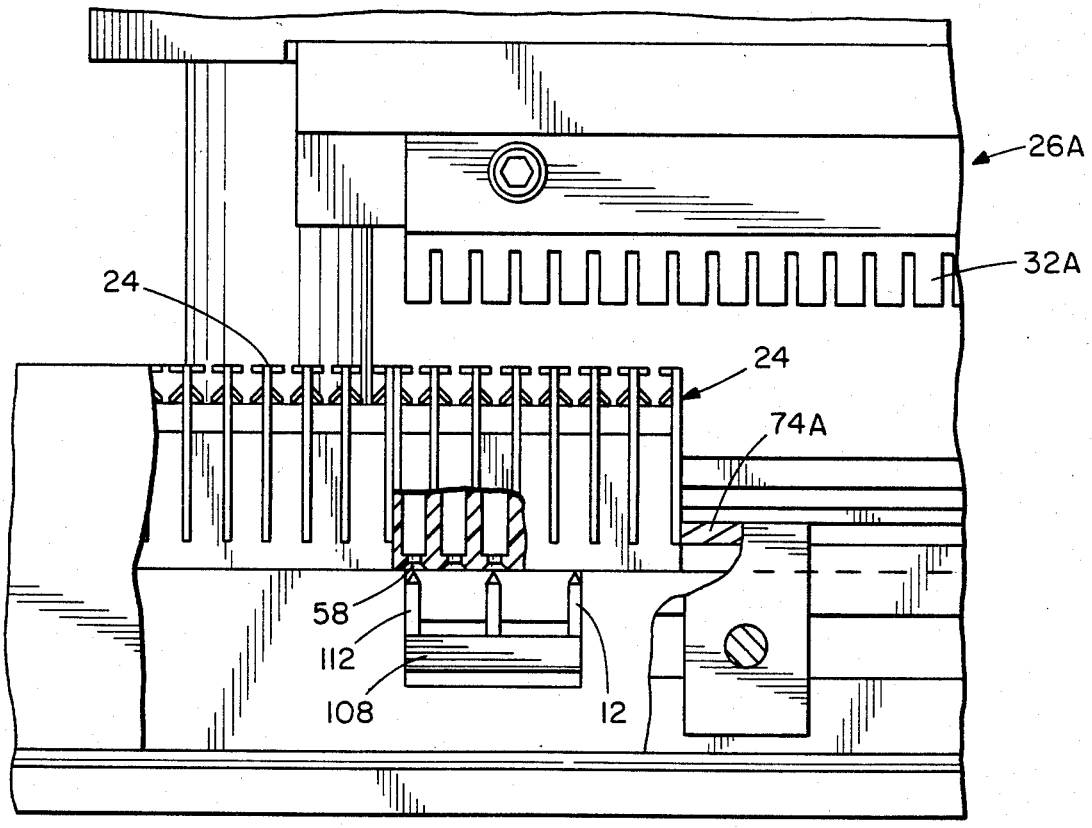
FIG. 15 is a sectional view of the modified tool taken generally along line 15—15 of FIG. 14.
Figure 16:
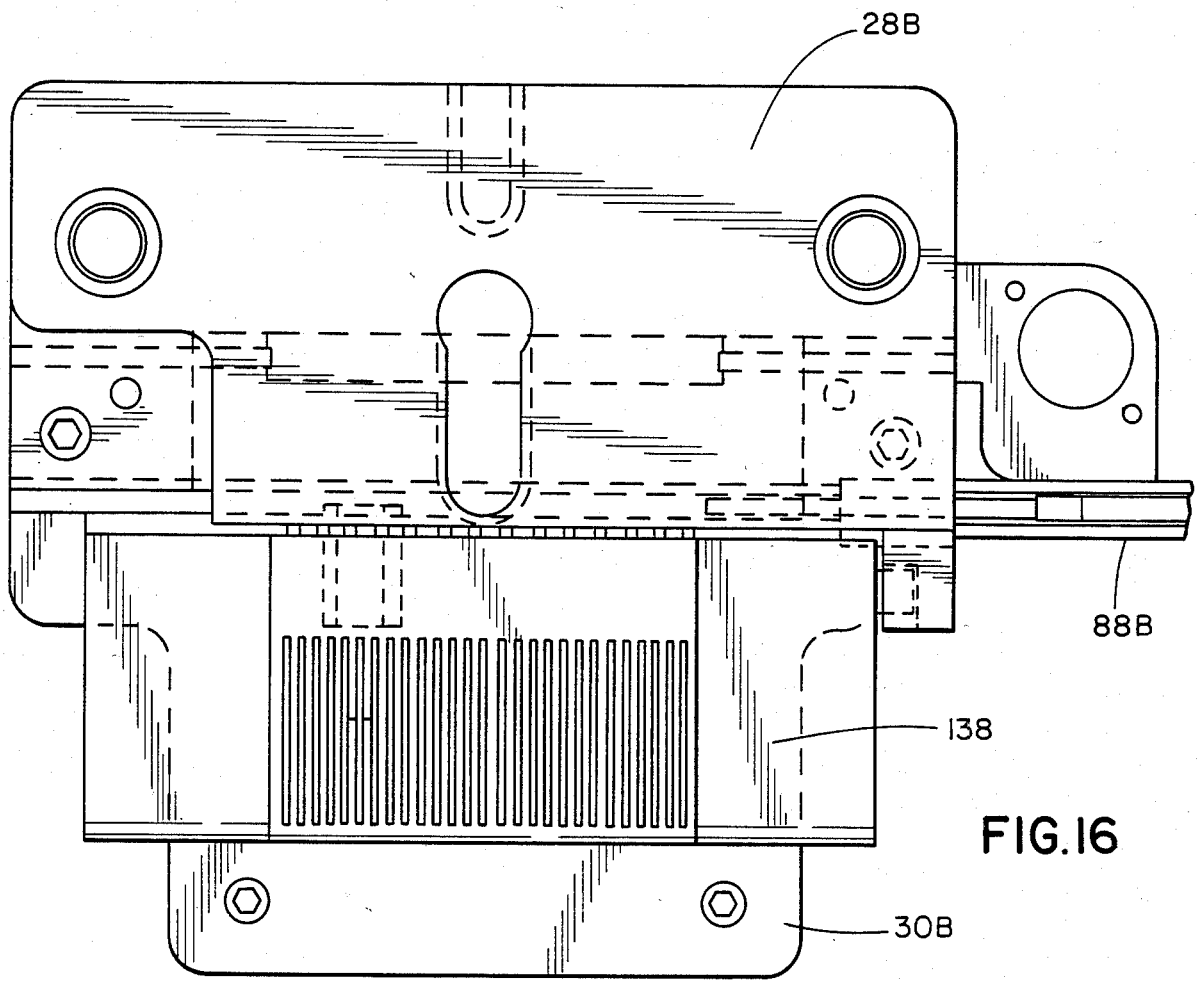
FIG. 16 is a plan of another modified tool having alternate stop means and alternate precision alignment means.

Referring to FIGS. 14 and 15, a modified embodiment of the tool assembly of the present invention is shown wherein the tool assembly further comprises precision alignment means for aligning the connector with the die set. Connector housing 38 is preferably made of plastic which is a hygroscopic material. Depending on temperature and humidity conditions structures formed of plastic will absorb or desorb moisture. Absorption results in a growth of the plastic formation while desorption results in shrinkage thereof. While a tool using only a stop to abut the one connector end is adequate for use with a connector housing of known moisture content, absorption of moisture may cause the housing to grow so that cavities 44 adjacent the other end of the cavity are misaligned with the die set. The precision alignment means is useful to shift or compress a connector housing into realignment with the die set. Components of modified tool assembly 26A similar to components of tool assembly 26 are designated by the reference number of the component of tool assembly 26 with the suffix "A".

Floor 66A includes a generally horizontal cavity 106 in which a lever 108 is pivotally mounted. The floor also includes an opening 110 underneath the pin-receiving face of the connector housing and communicating with cavity 106 for receiving a plurality of upstanding fingers 112, aligned with the dies of die set 32A and carried at one end of lever 108. The remaining end of lever 108 is in engagement with one end of a compression spring 113, with the other end of the spring engaging a plunger 114 dependent from upper support 28. Lever 108 is movable from a retracted position, shown in FIG. 14, wherein the lever is not moved by plunger 114 and fingers 112 underlies the connector, to an alignment position in which the plunger has pivoted lever 108 causing fingers 112 to enter corresponding apertures 58 in the pin-receiving face 56 of the connector.

The distal ends of the fingers 112 are tapered so that they can enter the connector even if it is slightly misaligned. However, as the fingers move further inside the apertures, the cross-sectional area of the portion of the fingers entering increases causing a misaligned connector to be shifted into precise alignment with the die set 32A. Lever 108 is biased by a spring 116 to its retracted position. The characteristics of springs 113 and 116 are such that as ram 29 moves from its retracted position, plunger 114 causes lever 108 to move fingers 112 fully into apertures 58 prior to die set 32A moving the flat cable 60 into the connector. With continued extension of the ram, spring 113 is compressed and as the ram retracts spring 116 returns lever 108 withdrawing fingers 112 to enable the terminated connector to be removed from tool assembly 26A as previously described with respect to tool assembly 26.

Referring now to FIGS. 16–20, another alternate embodiment of the tool assembly of the present invention is shown wherein alternate precision alignment means and stop means are used, and the feed track is positioned to supply connector to the right side of the connector holding channel. Components of modified tool assembly 26B similar to components of tool assemblies 26 or 26A are designated by the reference number of the components of those tool assemblies with the suffix "B".

Figure 17:
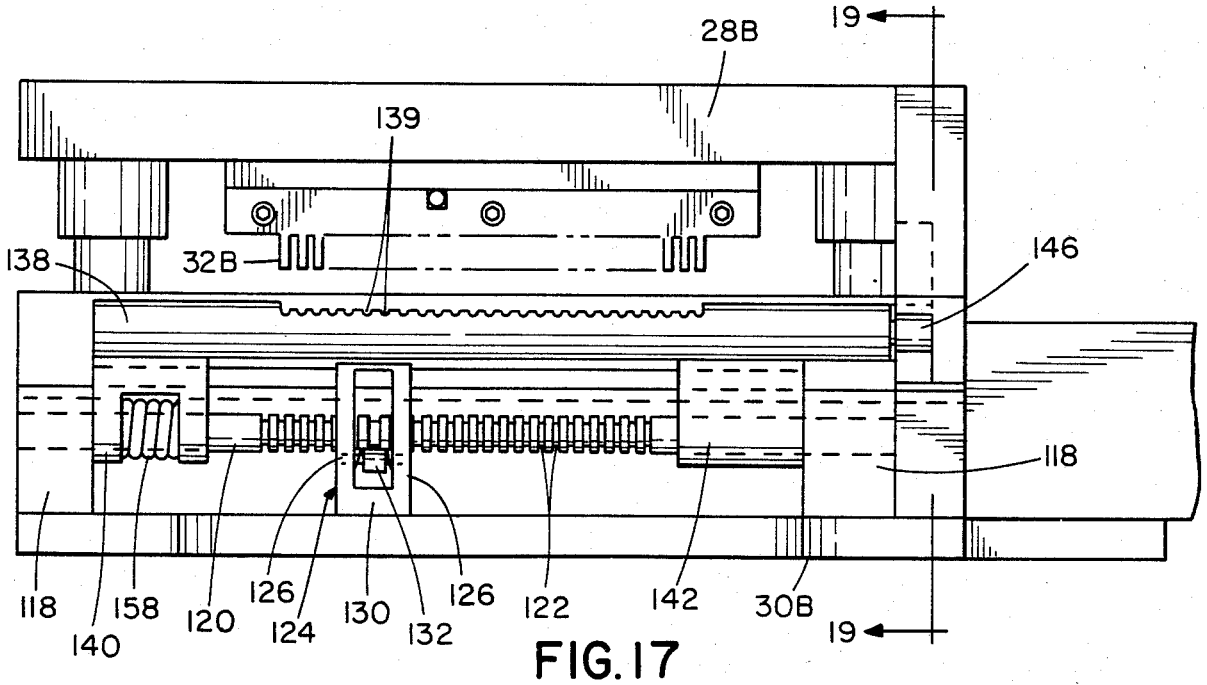
FIG. 17 is a front elevational view of the tool of FIG. 16.

As shown in FIG. 17, positioned on lower support 30B are a pair of mounting blocks 118, one adjacent each end of front wall 68B. Blocks 118 carry a support rod 120 extending generally parallel to front wall 68B, the intermediate portion of the rod having a plurality of regularly spaced annular grooves 122 for adjustably seating stop means comprising a frame 124 including a pair of spaced parallel side walls each having an aligned aperture 128 for slidably receiving rod 120. The spacing between adjacent grooves 122 is analogous to the spacing between adjacent terminal elements in connector 24. Joining the side walls are a floor 130 and an intermediate wall 131 from which extends horizontally, over channel front wall 68B, stop 74B to limit insertion of a connector into channel 64B. Pivotally connected between side walls 126 is a release lever 132 the top surface of which carries a tooth 134 sized to tightly fit in a groove 122. A compression spring 136 retained by a nest in floor 130 biases release lever 132 against rod 120. Actuation of lever 132 to withdraw tooth 134 allows the operator to move frame 124 along rod 120 to set the extent of connector insertion in channel 64B for a given size connector. Release of lever 132 causes tooth 134 to enter a groove 122 to lock the stop means in position.

Figure 18:
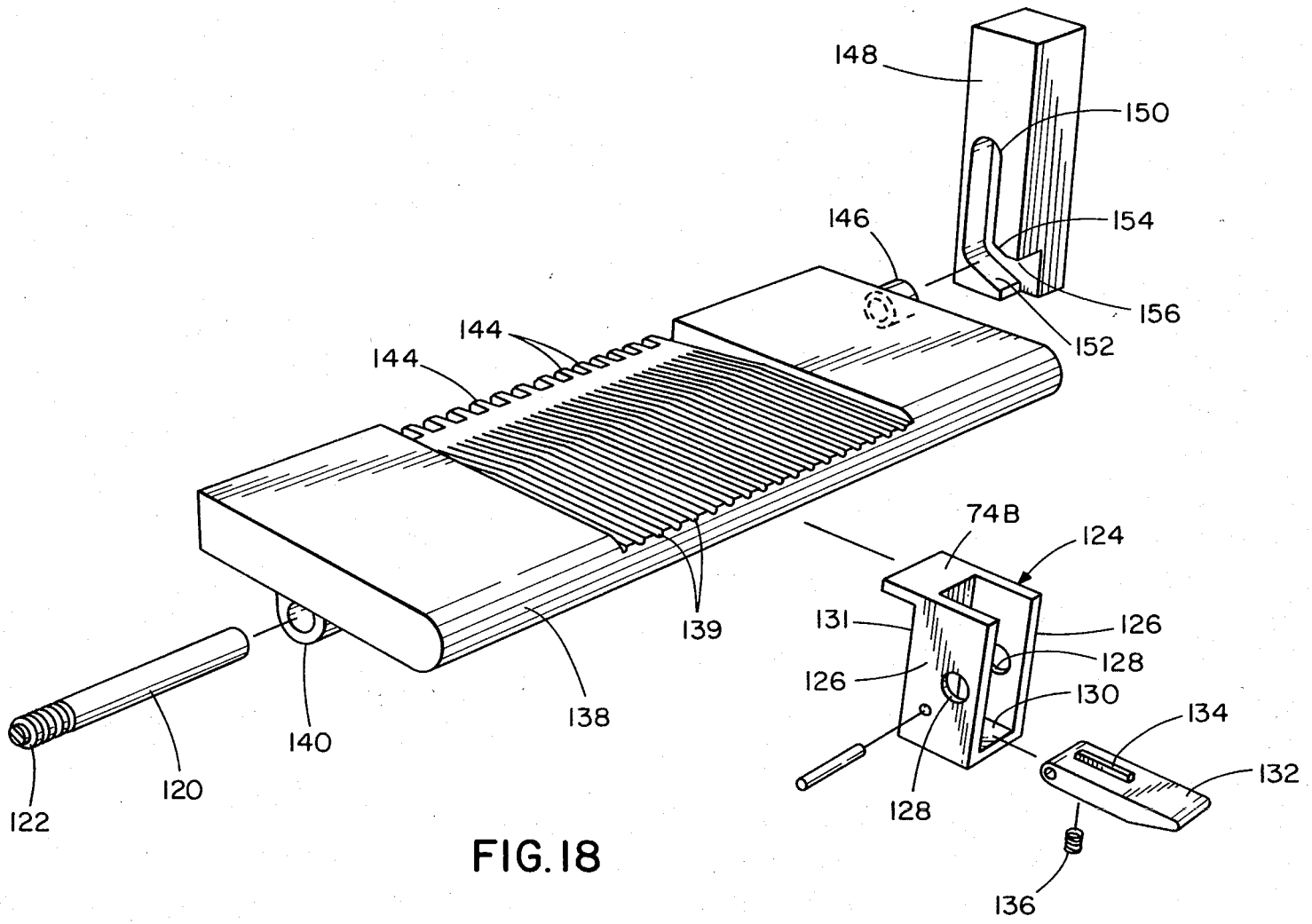
FIG. 18 is a perspective view of a wire tray used in the tool of FIG. 16 along with a box cam for moving the tray is response to movement of a ram, and stop means for limiting insertion of a connector.
Figure 19:
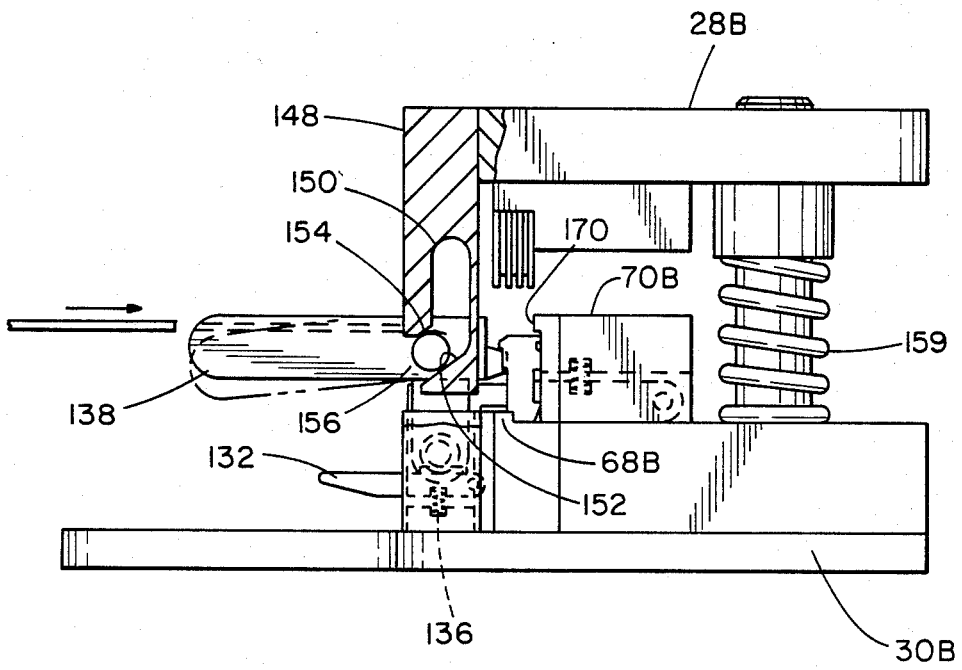
FIG. 19 is side elevational view with certain components removed illustrating the wire tray in its insertion and holding positions.

The alternate embodiment of the precision alignment includes a wire tray 138 having a pair of dependent legs 140, 142 having apertures for pivotally receiving support rod 120 with each leg contiguous with a corresponding mounting block so that the tray is prevented from sliding in the longitudinal direction of rod 120. The top surface of tray 138 has spaced wire grooves each aligned with a corresponding die 33B of die set 32. As best shown in FIG. 18 extending from tray 138 toward a connector positioned in channel 64B are a plurality of regularly spaced precision alignment fingers 144 for reception between adjacent ribs 61 on connector front wall 38. Each finger 144 is tapered with its distal end having a width less than the spacing between adjacent ribs 61 and its root end having a width approximating the spacing between adjacent ribs. Fingers 144 serve as clamping means to compress the connector housing against channel rear wall 70B which has increased height and includes a stop 170 to position the flat cable for termination.

Extending from a side of wire tray 138 is a cam rod pivotally retaining a cam follower 146. Dependent from upper support 28B is a cam box 148 having a cam surface 150 engaging cam follower 146 for controlling pivotal movement of the wire tray. More specifically, the cam surface includes a ramp 152 for engaging the cam follower when the ram 29 is retracted to move the fingers to an insertion position in which the fingers are removed from ribs 61 to permit loading of connector into channel 64B without interference from the fingers. Cam surface 150 also includes a ramp 154 for moving the fingers from their insertion position to a clamping position wherein the fingers move between ribs 61 to shift, contract or expand connector housing 36 so that each terminal element 46 is in registration with its corresponding die 33B, in response to the press ram moving from its retracted position toward its extended position.

Figure 20:
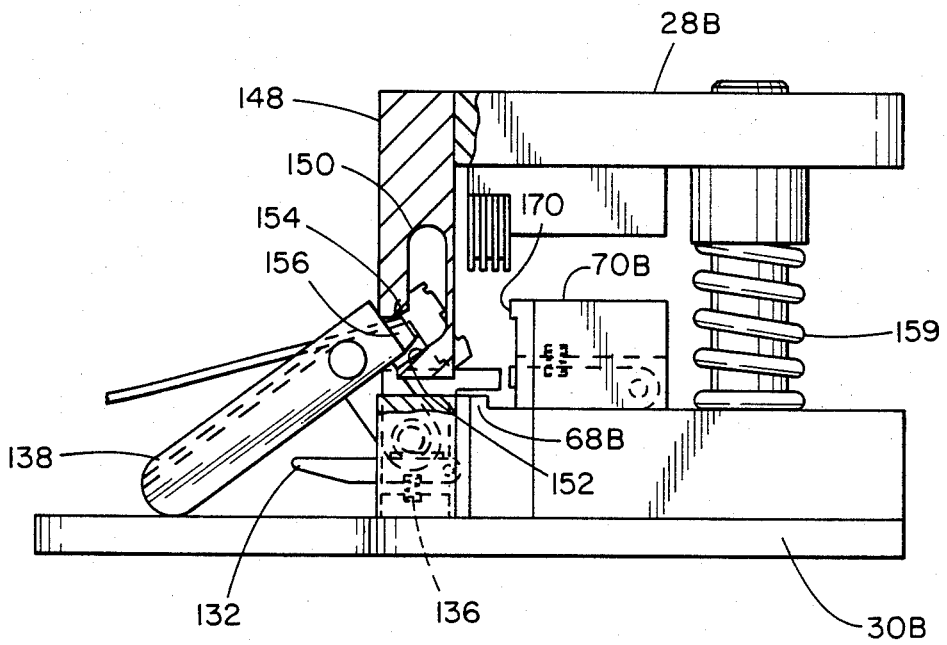
FIG. 20, similar to FIG. 19, illustrates the wire tray moved to its release position.

The cam box has an exit 156 aligned with cam follower 146 when ram 29 is retracted allowing the wire tray to be rotated to a release position, shown in FIG. 20, when it is desired to remove a terminated connector from channel 64B. Note that leg 140 is bifurcated and retains a torsion spring 158 which biases the wire tray away from its release position causing the cam follower to reenter the cam box upon release of the wire tray. Except for the alternate embodiments of the stop means and precision alignment means, the operations of which have just been described, operation of tool assembly 26B is similar in operation to tool assembly 26, described above.

In view of the above, it will be seen that the several objects of the invention are achieved and other advantageous results attained.

As various changes could be made in the above constructions without departing from the scope of the invention, it is intended that all matter contained in the above description shall be interpreted as illustrative and not in a limiting sense.

What is claimed is:

1. A tool assembly for use with a prime mover, such as a bench press, for terminating a plurality of insulated conductors in a mass termination connector having a plurality of insulation displacement terminal elements corresponding to said conductors, said tool assembly comprising:

a pair of supports, at least one of which includes means for attachment to said prime mover to effect reciprocal movement of one of said support relative to the other of said supports;

a conductor insertion die set, comprising an insertion die corresponding to each connector terminal element, carried by one of said supports for inserting said conductors into corresponding terminal elements of said connector;

connector holding means carried by the other of said supports for holding said connector in alignment with said die set, said holding means including a channel for seating the connector to be terminated, said channel being defined by a front wall, rear wall, and a floor extending between said walls, said rear wall including a window; and connector release means for retaining said connector in said holding means, said release means having a connector retention position and a connector release position, said release means being biased to said retention position, whereby moving said connector sufficiently to overcome the bias results in release of said connector from said holding means, said connector holding means comprising an arm extending through said window and positioned to interfere with attempted removal of a connector located in said channel.

2. A tool assembly as set forth in claim 1, further comprising a feed track, holding a series of connectors, joined to said connector holding means, said feed track including means for urging said connectors toward said holding means whereby upon removal of a connector from said holding means, another connector is loaded therein.

3. A tool assembly as set forth in claim 2, further comprising adjustable stop means carried by said connector holding means for limiting the extent of insertion of a connector therein whereby said tool assembly can accommodate connectors having various numbers of terminal elements.

4. A tool assembly as set forth in claim 1, wherein said connector includes a housing including a conductor receiving face and a second face having apertures corresponding to each terminal element, said tool assembly further comprising precision alignment means for entering at least one of said apertures to move a misaligned connector into alignment with said die set prior to termination of said conductors.

5. A tool assembly for use with a prime mover, such as a bench press, for terminating a plurality of insulated conductors in a mass termination connector having a plurality of insulation displacement terminal elements corresponding to said conductors, said tool assembly comprising:

a pair of supports, at least one of which includes means for attachment to said prime mover to effect reciprocal movement of one of said supports relative to the other of said supports;

a conductor insertion die set, comprising an insertion die corresponding to each connector terminal element, carried by one of said supports for inserting said conductors into corresponding terminal elements of said connector;

connector holding means carried by the other of said supports for holding said connector in alignment with said die set, said holding means including a channel for seating the connector to be terminated, said channel being defined by a front wall, a rear wall, and a floor extending between said walls; and connector release means for retaining said connector in said holding means, said release means having a connector retention position and a connector release position, said release means being biased to said retantion position, whereby moving said connector sufficiently to overcome the bias results in a release of said connector from said holding means, wherein said front wall is low with respect to the height of said connector and said front wall acts as a fulcrum during connector release.

6. A tool assembly as set forth in claim 5, further comprising a feed track, holding a series of connectors, joined to said connector holding means, said feed track including means for urging said connectors toward said holding means whereby upon removal of a connector from said holding means, another connector is loaded therein.

7. A tool assembly as set forth in claim 6, further comprising adjustable stop means carried by said connector holding means for limiting the extent of insertion of a connector therein whereby said tool assembly can accommodate connectors having various numbers of terminal elements.

8. A tool assembly as set forth in claim 5, wherein said connector includes a housing including a conductor receiving face and a second face having apertures corresponding to each terminal element, said tool assembly further comprising precision alignment means for entering at least one of said apertures to move a misligned connector into alignment with said die set prior to termination of said conductors.

9. A tool assembly for use with a prime mover, such as a bench press, for terminating a plurality of insulative conductors in a mass termination connector having a plurality of insulation displacement terminal elements corresponding to said conductors, said tool assembly comprising:

a pair of supports, at least one of which includes means for attachment to said prime mover effect reciprocal movement of one of said supports relative to theother of said supports;

a conductor insertion die set, comprising an insertion die corresponding to each connector termination element, carried by one of said supports for inserting said conductors into corresponding terminal elements of said connector;

connector holding means carried by the other of said supports for holding said connector in alignment with said die set, said holding means including a channel for seating the connector to be terminated, said channel being defined by a front wall, a rear wall, and a floor extending between said wall, said rear wall including a window; and connector release means for retaining said connector in said holding means, said release means having a connector retention position and a connector release position, said release means being biased to said retention position, whereby moving said connector sufficiently to overcome the bias results in a release of said connector from said holding means, wherein said connector holding means includes an arm extending through said window and positioned to interfere with attempted removal of a connector located in said channel and wherein said connector includes a housing having a foot portion extending toward said rear wall, said arm closely overlying said foot portion when said arm is in its connector retention position.

10. A tool assembly as set forth in claim 9, further comprising a feed track, holding a series of connectors, joined to said connector holding means, said feed track including means for urging said connectors toward said holding means whereby upon removal of the connector from said holding means, another connector is loaded therein.

11. A tool assembly as set forth in claim 10 further comprising adjustable stop means carried by said connector holding means for limiting the extent of insertion of a connector therein whereby said tool assembly can accommodate connectors having various numbers of terminal elements.

12. A tool assembly as set forth in claim 9, wherein said connector includes a housing including a conductor receiving face and a second face having apertures corresponding to each terminal element, said tool assembly further comprising precision alignment means for entering at least one of said apertures to move a misaligned connector into alignment with said die set prior to termination of said conductors.

13. A tool assembly for use with a prime mover, such as a bench press, for terminating a plurality of insulated conductors in a mass termination connector having a plurality of insulation displacement terminal elements corresponding to said conductors, said tool assembly comprising:

a pair of supports, at least one of which includes means for attachment to said prime mover to effect reciprocal movement of one of said supports relative to the other of said supports;

a conductor insertion die set, comprising an insertion die corresponding to each connector terminal element, carried by one of said supports for inserting said conductors into corresponding terminal elements of said connector;

connector holding means carried by the other of said supports for holding said connector in alignment with said die set, said holding means including a front connector positioning edge, a rear connector positioning edge opposing said front edge and a floor means for positioning the connector between said front and rear edges, the highest extent of said front edge being positioned to engage the lower portion of said connector wherein said front edge is low with respect to the height of said connector and said front edge acts as a fulcrum during connector removal; and connector release means for retaining said connector in said holding means, said release means having engagement means for trapping a lower edge of said connector within said holding means and having biasing means for biasing said engagement means against said lower edge of said connector, said engagement means being disposed relative to said lower edge such that after termination of said conductors within said connector, withdrawl of said conductors away from said front edge pivots said connector against said front edge and overcomes the bias of said engagement means effecting release of said connector from said holding means.

14. A tool assembly as set forth in claim 13, further comprising a feed track, holding a series of connectors, joined to said connector holding means, said feed track including means for urging said connectors toward said holding means whereby upon removal of a connector from said holding means, another connector is loaded therein.

15. A tool assembly as set forth in claim 14, further comprising adjustable stop means carried by said connector holding means for limiting the extent of insertion of a connector therein whereby said tool assembly can accommodate connectors having various numbers of terminal elements.

16. A tool assembly as set forth in claim 13, wherein said connector includes a housing including a conductor receiving face and a second face having apertures corresponding to each terminal element, said tool assembly further comprising precision alignment means for entering at least one of said apertures to move a misaligned connector into alignment with said die set prior to termination of said conductors.

* * * * *